US005292223A

United States Patent [19]

Meschi

[11] Patent Number: 5,292,223

[45] Date of Patent: Mar. 8, 1994

[54] AUTOMATIC DEVICE FOR ALIGNING PAPER-SHEETS IN A PACKAGE

[75] Inventor: Luciano Meschi, Leghorn, Italy

[73] Assignee: Industria Grafica Meschi SRL, Livorno, Italy

[21] Appl. No.: 683,877

[22] Filed: Apr. 11, 1991

[30] Foreign Application Priority Data

Apr. 23, 1990 [IT] Italy ..... 20108 A/90
Oct. 3, 1990 [IT] Italy ..... 21875/90 [U]

[51] Int. Cl.[5] ..... B65H 31/34

[52] U.S. Cl. ..... 414/788; 414/789.1; 414/907

[58] Field of Search ..... 271/221, 222; 414/788.9, 789.1, 900, 907, 789, 795.7

[56] References Cited

U.S. PATENT DOCUMENTS 3,409,148 11/1968 Shields ..... 414/900 X
3,893,665 7/1975 Greene ..... 271/221
3,900,115 8/1975 Kumagai ..... 271/222 X
3,912,258 10/1975 Martin ..... 414/788.9 X
4,047,713 9/1977 Snellman et al. ..... 271/221
4,427,330 1/1984 Carter ..... 414/795.7

*Primary Examiner*—Michael S. Huppert
*Assistant Examiner*—Janice Krizek
*Attorney, Agent, or Firm*—McAulay Fisher Nissen Goldberg & Kiel

[57] ABSTRACT

A device for aligning a continuous paper sheet strip stored in a stacker (10), to form a package (14), which includes a first lateral locator (20) transversally fixed and vertically movable and a second lateral locator (50) movable both laterally and vertically; the locators (20, 50) include telescopically-shaped rods, the external rod (52, 62) thereof being cylindrical in shape. In order to move the second locator (50), a motor, a pair of rods and a worm screw are provided which is located in a region over the collector (10) and do not protrude laterally with respect thereto.

2 Claims, 2 Drawing Sheets

AUTOMATIC DEVICE FOR ALIGNING PAPER-SHEETS IN A PACKAGE

This invention is concerned with a device for aligning a continuous, accordionlike folded paper-sheet strip along preset separating or folding lines and stored in a stacker for forming a package. Continuous strips of this kind are usually delivered by fast printers, as the so called "laser" printers, as for example the ones used in accounting and data processing centers.

The paper sheets processed in these printers are usually affected by mechanical distortions due to unavoidable strains provided along a path between many different rolls and also thermal strains due to the printing.

Accordingly, the continuous sheet strip delivered by said printers can be slightly distorted in some areas, so that the sheets stored into stackers can remain irregulate resulting in that the stacked sheets are staggered with respect to each other and a consequent result that the package does not appear perfectly squared and compacted.

In order to obviate this problem it has been suggested that fixed walls be built on the collecting plane of the stacker in order to contain the sheets uniformly aligned and prevent the staggering of any sheet delivered by the printer.

However, it has been found that such a remedy does not give satisfying results because only major staggerings can be settled, while the minor ones cannot be settled because excessive care in wall spacement and sheet size can cause remarkable problems in stacking the sheets.

Another provision for remedying the problem has been to provide the stacking plane with transversally movable walls in order to set the spacing between the walls and the format of the sheets to be stacked.

However, also in this case it has been noticed that the existence of some interference between sheets and walls causes some remarkable problems in stacking sheets.

It is an object of the present invention to provide a device for aligning a continuous strip of folded sheets delivered by "laser" printers, or the like, in such a way that said sheets do not have staggerings and the package format appears well squared and compacted.

It is a further object of the present invention to provide a folded sheet aligning device not further protruding from the lateral size thereof.

The subject matter of the present invention is consequently directed to a device for aligning a continuous sheet strip folded along a separation or folding line and stacked in a stacker for forming a package, comprising a horizontal plane movable in vertical direction characterized by comprising:

- a first lateral locator arranged on a side of the plane, fixed in a lateral direction and movable in a vertical direction,
- a second lateral locator arranged on the opposed side of the plane, movable in both transversal and vertical directions.

According to a preferred embodiment, every locator comprises at least a rectilinear vertical rod formed by at least two telescopically arranged sections which can telescope relative to each other.

According to a further preferred embodiment, the radially external portion facing the stacking plane has a convex shape, and is preferably radially a more external portion having a cylindrical shape.

According to a first variation of the present invention, said second locator comprises a device for the movement in a transversal direction and a sensor for stopping said locator in a given location.

Preferably said device comprises a worm screw connected to a carriage mounting an arm extending in the tranversal direction to which end is fastened said second locator.

Preferably, said sensor is fastened to the lower end of said second locator.

According to another embodiment, the present invention provides an aligning device of a continuous strip of folded sheets, stacked in a stacker for forming a package, comprising a stacking horizontal plane movable in a vertical direction, a first lateral locator arranged at a first side of said plane, fixed in the tranversal direction and movable in the vertical direction and a second lateral locator arranged at a second and opposed side of said plane and movable in both transversal and vertical directions, characterized by comprising:

- means for tranversally moving said second lateral locator comprised in an area over said stacker and substantially not protruding therefrom.

Preferably, said means for transversally moving said second locator consist of a massive piece, slidable on at least a transversal rail, moving a descending rod provided, at the bottom, with said second locator.

More preferably, said means for transversally moving said second locator consist of a metallic massive block moved by a mechanism comprising a turnable threaded shaft or worm screw, engaged in a corresponding threaded bore in said massive block, and driven by a fixed smooth rod parallel to the threaded shaft, and said shaft and rod are located substantial transversally with respect to said package.

Particularly, said turnable threaded shaft and fixed smooth rod are fastened to two walls parallel to the sides of said package.

Preferably, said threaded shaft is moved by motor means controlled by the width of the continuous paper strip for transversally positioning the movable locator depending from the width of the paper strip forming the package.

More preferably, said motor means consist of an electric motor coupled to said threaded shaft.

According to a preferred variation, said transversally movable locator comprises a sensor for stopping said locator at a side of said package.

Particularly, said sensor cooperates to control the motor means moving said threaded shaft.

BRIEF DESCRIPTIONS OF THE DRAWINGS

These and other features, as well as the related advantages, will be more apparent from the following detailed, but not limiting, description provided with the accompanying drawings enclosed, wherein.

DESCRIPTION OF THE PREFERRED EMBODIMENTS

Like numerals are given to like portions or members in both the figures of the drawings.

Figure 1:
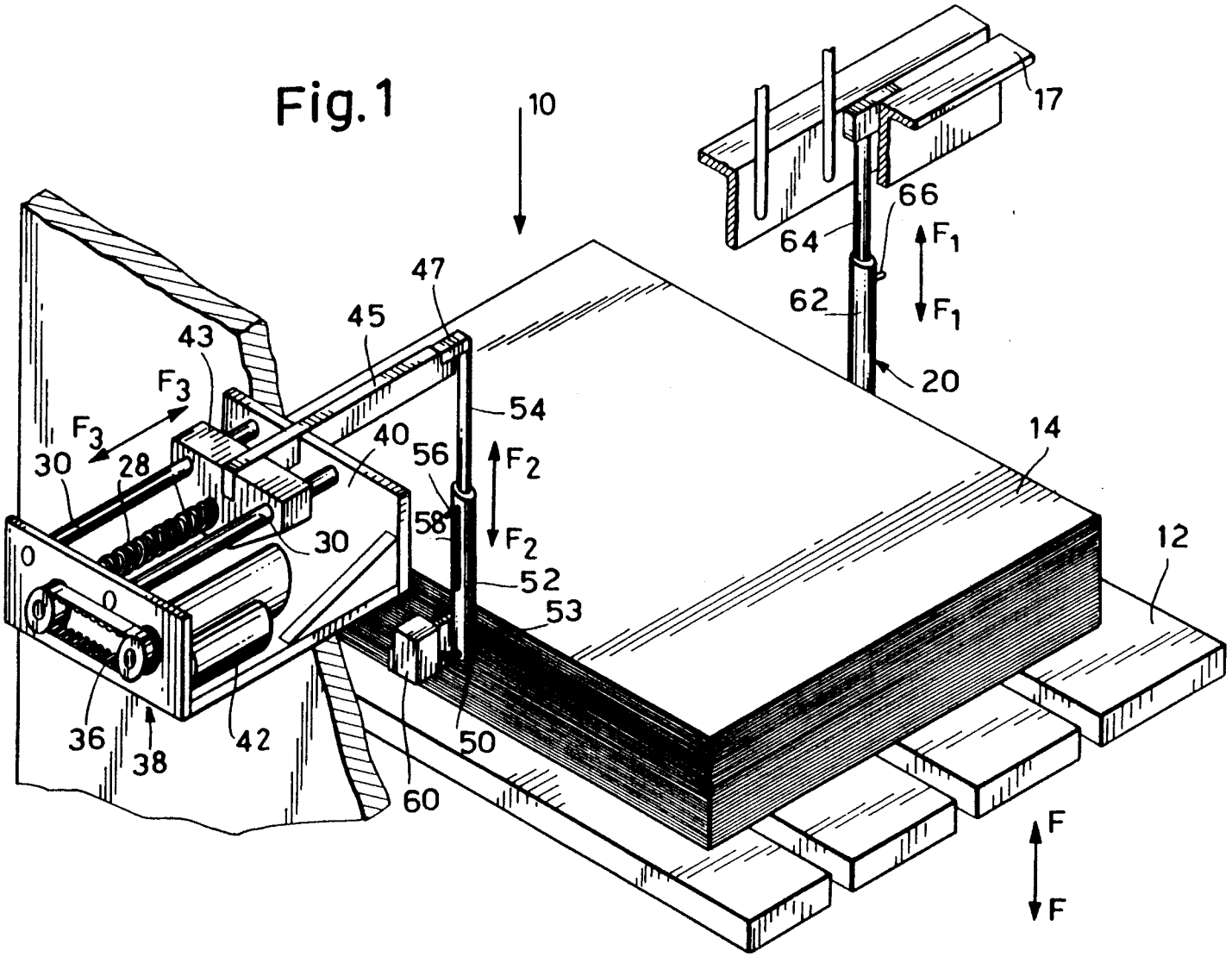
FIG. 1 is a perspective view of a first embodiment of the device for aligning a continuous folded sheet strip stored in a stacker according to the present invention.

Referring to FIG. 1, the device 10 has a stacking plane 12 consisting of a plurality of metallic rods or boards parallel arranged relative to each other to form a plane surface, and the folded sheets delivered by a "laser" printer (not depicted) arranged over the device 10 and forming a package 14 are collected on the stacking plane 12.

The stacking plane 12 is movable in a vertical direction in the direction indicated by the arrows F and actuated by a stepping motor (not depicted) driven y the printer. At a side of the stacking plane 12 a fixed frame 17 is arranged for sustaining a first lateral locator 20 which locator is fixed in a transverse direction with respect to the stacking plane 12 and movable with respect to a vertical direction indicated by the arrows $F_1$.

At the opposite side of the stacking plane, there is arranged a second fixed frame 40 sustaining a second lateral locator 50 (other members sustained by the frame 40 will be herebelow considered); such a locator 50 is movable both in the vertical direction indicated by the arrows $F_2$, and in the transverse direction indicated by the arrows $F_3$.

As depicted in FIG. 1, both the locators 20 and 50 consist of straight rods formed, by two pairs of coaxial cylinders 54, 52 and 64, 62, respectively which able to slide telescopically one into the other one (usually called telescopic cylinders).

A reciprocal sliding length is determined by the length of a window or slot 58 in the wall of the radially most external cylinder 52 from which protrudes a pin 56 connected to the radially most internal cylinder 54.

While the two locators 20, 50 are depicted as two telescopic cylinders, actually they can have different geometrical shapes, so the upper portions 54, 64 of the rods can have elliptical, squared, hexagonal or other shapes preferably coinciding with the shape of the internal member of the lower portions 52, 62.

The external shape of the lower portions 52, 62 can also be different from a circular shaped profile, what matters is a convex profile (possibly also provided with edges facing towards the stacking plane 12.

In such a way, the sheet delivered by the printer has a "point shaped" contact with the surfaces of the two locators 20, 50, against a "linear shaped" contact happening in the case of a planar external profile of the lower portions 52, 62.

It will be noticed that the convex point shaped contact profile provides the minimum contact between sheet and lateral locators with a great advantage in terms of mutual sliding.

The frame 40 supports also a worm screw 28, moved by motor means 38 comprising an electric motor 42, by means of a belt 36. The worm screw 28 is connected to the movable carriage 43 mounted on a pair of rods 30.

On the carriage 43 is mounted an arm 45 extending in transverse direction with respect to the stacking plane 12.

At the end 47 of the arm 45 is fastened the upper portion 54 of the locator 50. The motor 42 is actuated by the printer; should it rotate in a first direction the worm screw 28 drives the carriage 43, with the arm 45 and then the locator 50 in the transverse direction $F_3$ to the stacking plane 12; should the motor 42 rotate in a second contrary direction, the carriage 43, the arm 45 and the locator 50 are moved in an opposite transverse direction $F_3$, moving them away from the stacking plane 12.

The lateral locator 50 is provided at the lower end 53 with a sensor 60, which by contacting the sheet package 14, stops the motor 42 and sets the second lateral locator 50 in a determined location.

Just for further clarity it is to add that the first lateral locator 20, which is fixed in transverse direction, is not provided with similar devices for a shifting in such a direction.

Depicting the operation of the device 10, in a starting step, when the printer begins to operate, the stacking plane 12 is in the upmost position and the frame 40 is in the furthest position from the plane 12; the lower ends of the lateral locators 20, 50 abut on the stacking plane 12. The continuous strip of sheets "accordion" folded along separating or folding lines is delivered by the printer and by proper means is driven to the plane 12, so that the lateral edges of the sheets or strip lightly touch the convex profile of the lower portion 62 of the lateral locator 20.

The first sheets are stacked on the plane 12 for beginning the package 14 formation.

The printer actuates the stepping motor (not depicted) which gradually lowers the plane 12 and the lower telescopic portions 52, 62 of the lateral locators 50, 20 are accompanied therewith, coming out from the upper portions 54, 64 according to the whole length of the window 58.

The printer actuates also the motor 42 which through the belt 36 and the worm screw 28 advances the carriage 43, the arm 45, the lateral locator 50 and the sensor 60 to the plane 12.

When the sensor 60 contacts the lateral edges of the first sheets just stacked as a package on the plane 12, it stops the motor 42, locking the position of the lateral locator 50.

The folded sheet strip is continuously delivered by the printer to the stacking plane 12 and the lateral edges thereof are driven through pointlike contacts by the convex profiles of the locators 20, 50 gradually forming a not staggered, well squared and compact package.

When the operation of the printer is ended, the sheet package 14 is moved away and the device is returned to the starting position, completely clearing the stacking plane to possibly receive other sheet formats to which the device will be automatically adapted.

While in the preceeding disclosure, there has been provided a stepping motor for gradually lowering the stacking plane 12, in simpler devices said plane can be fixedly mounted at a proper distance from the printer output.

Figure 2:
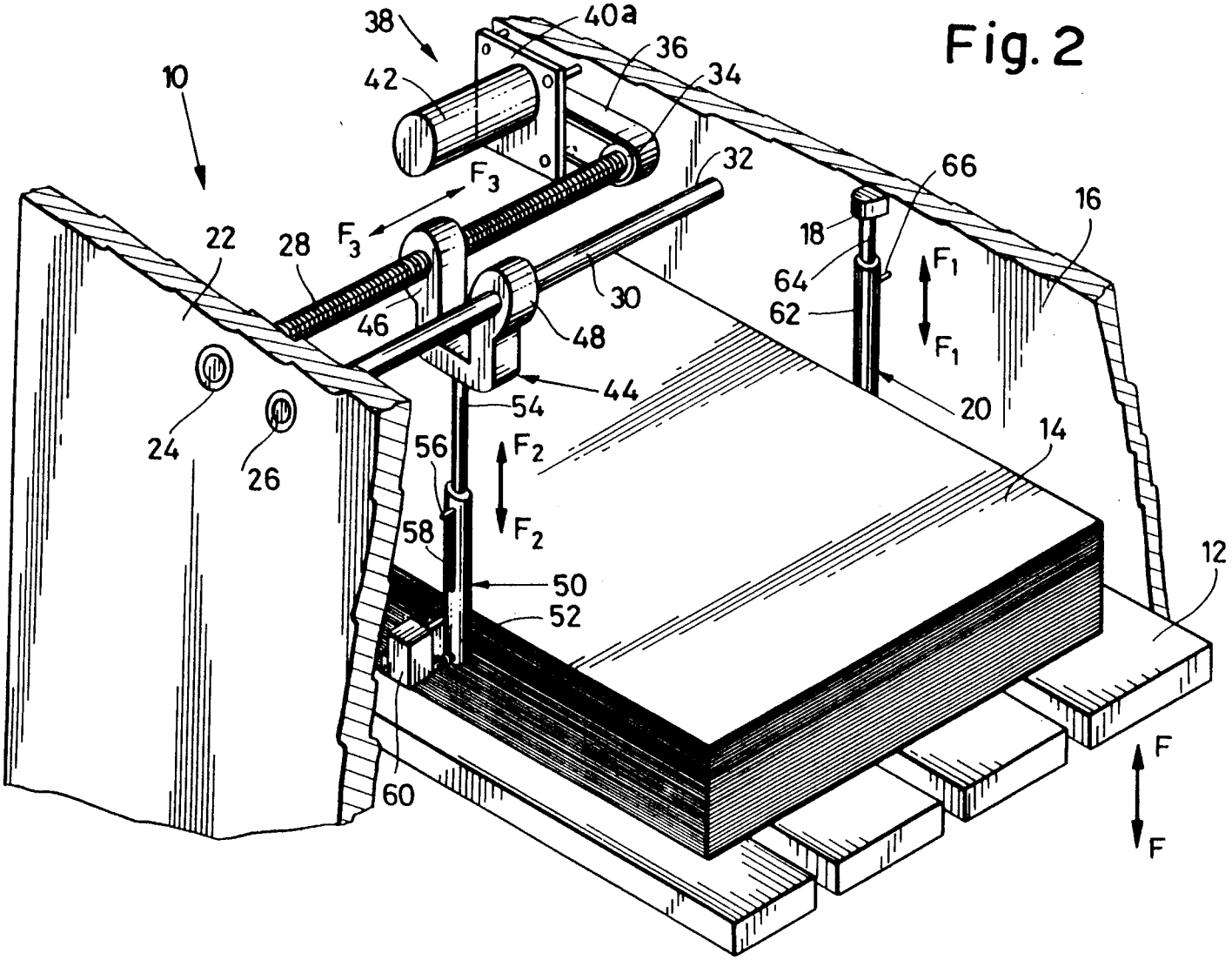
FIG. 2 is a perspective, partially broken, view of a second embodiment of the same device for aligning a continuous strip of folded sheets.

Referring to FIG. 2 and similarly with respect to FIG. 1, the device 10 is provided with a stacking plane 12, consisting of a plurality of metallic rods parallel with each other and parallely arranged, said plane stacking the folded sheets delivered by the "laser" printer(not shown) and arranged over the device 10 and forming a package 14. The stacking plane 12 is movable in a vertical direction as indicated by arrows F and is driven by a stepping motor (not shown) controlled by the printer itself. Along a first side of the stacking plane 12 is arranged a first fixed wall 16, delimitating the package on that side, supporting a bracket 18 for a first lateral locator 20 fixed in a transverse direction and movable in a vertical direction indicated, for example, by arrows $F_1$. Along a second side, opposed with respect to the first one, of the stacking plane 12, there is arranged a second fixed wall 22 provided with circular openings 24 and 26 having the disclosed hereinafter.

Effectively, the circular opening 24 houses a bearing allowing the rotation of a threaded shaft 28 supported by said wall 22 and the opening 26 fixedly houses a cylindrical circular smooth rod 30, the threaded shaft 28 and the rod 30 being similarly housed in the opposed wall 16, as shown by the opening 32 partially shown in FIG. 2.

The threaded shaft 28 is provided with a pulley 34 which through a belt 36 is driven by motor means 38 consisting of a support base 40a and an electric motor 42.

Between the threaded shaft 28 and the smooth bar 30 is arranged a yoke 44 comprising a first bushing 46 provided with a threaded bore adapted to receive the threaded shaft 28 and a second bushing 48 provided with a smooth bore strictly fitted to the smooth rod 30. Said yoke 44 is a support for a second lateral locator 50, movable both transversally and vertically, formed by a lower cylindrical body or cylinder 52 bearing coaxially fitted an upper cylindrical body or cylinder 54, in turn mounted to said yoke 44. The lower cylinder 52 is movable with respect to the upper cylinder 54, but limited in the movement by a pin 56 fastened to the upper cylinder and slidable within a slot 58 cut in the lower cylinder 52, the assembly of said pin 56 and slot 58 allowing a movement of the lower cylinder 52 of the locator 50 according to the arrows $F_2$. The lower cylinder 52 itself is provided at the lower end with a sensor 60 sensing or detecting the contact of the locator 50 against the package 14.

Similarly, the opposed locator 20 is formed by a lower cylinder 62 bearing and fitted with an upper cylinder 64 also provided with a pin 66 limiting the movement of the lower cylinder 62 exactly in the same way as that of the pin 56.

As the locator 50 is connected to the yoke 44 which yoke 44 is moved by the means 38 through the threaded rotating shaft 28, to every turn of the electric mot-or 42 of said means 38, there corresponds a transverse movement of the locator 50 in the direction indicated by the arrows $F_3$ which, of course, according to a first rotating direction of the motor 42 will be in a first direction and according to an opposed or second rotating direction will be in the opposed or second direction, in accordance with what is already known and depicted in FIG. 1.

The operation of the device 10, which is very similar to the device depicted in FIG. 1, is the following:

when the printer begins to operate, the stacking plane 12 is in the uppermost position and the yoke 44 is in the position nearest to the second fixed wall 22; the lowest ends of the lateral locators 20 and 50 will abut against the stacking plane 12. The continuous strip of "accordion" folded sheets along separating or folding lines is delivered by the printer and is driven to the plane 12, so that the lateral edge of the sheets or strip lightly touches the first lateral locator 20. Thus the first sheets are stacked on the plane 12 for beginning the formation of the package 14.

The printer actuates the stepping motor (not shown) by gradually lowering the plane 12 and said plane 12 is accompained by the lower telescopic portions, consisting of the lower cylinders 52 and 62, of the respective locators 50 and 20, by descending from the upper cylinders 54 and 64 for the length of the slot 58.

The printer actuates also the motor 42 which through the belt 36, the pulley 34 and the threaded shaft 28 advances the yoke 44, the lateral locator 50 and the sensor 60 to the plane 12.

The contact of the sensor 60 with the lateral edges of the first sheets stops the motor 42, by locking the position of the lateral locator 50, for obtaining all the advantages of a right and well squared package already obtained by the embodiment depicted in FIG. 1 and, in addition, the advantage that, being all the mechanism, comprised of the threaded shaft 28, the yoke 44 and the adjacent hardware, contained in the space between the first fixed wall 16 and the second fixed wall 22, it happens that the total external dimensions of the device 10 is independent from the size of the sheets forming the package 14, because the threaded shaft 28, which can as long as the whole distance between the two walls 16 and 22, allows for an accommodation of a large multiplicity of package sizes by simply moving the yoke 44 and the locator 50 therewith.

The present invention has been disclosed according to preferred embodiments, but it is meant that changements and obvious variations for a person skilled in the art are possible without departing from the scope thereof.

I claim:

1. A device for aligning a continuous strip of flexible sheets of paper folded along a separating or folding line forming a package (14) comprising a horizontal stacking plate (12) movable in a vertical direction, and including:

a first lateral locator (20) arranged along one side of said plane (12) for contacting a side of said package (14) and movable in a vertical direction;

a second lateral locator (50) arranged along the opposed side of said plane (12) for contacting another side of said package (14) and movable in both a transversal and a vertical direction, and means for moving said second locator (50) in said transversal direction; and sensor means (60) for controlling a motor means of said moving means, said sensor means (60) being mounted at the lower end of said second locator (50).

2. A device for aligning a continuous strip of flexible sheets of paper folded along a separating or folding line forming a package (14) on a horizontal stacking plane (12) movable in a vertical direction, including:

a first lateral locator (20) arranged along one side of said plane (12) for contacting a side of said package (14) and movable in a vertical direction;

a second lateral locator (50) arranged along the opposed side of said plane (12) for contacting another side of said package (14) and movable in both a transversal and a vertical direction;

each said locator (20, 50) comprising at least a straight vertical rod formed by at least two pieces arranged telescopically with respect to each other, and each said locator including a radially most external piece (52, 62) having a convex shape facing towards the stacking plane (12); and moving means associated with said second locator (50) and sensor means (60) for controlling a motor means of said moving means.

* * * * *

UNITED STATES PATENT AND TRADEMARK OFFICE

CERTIFICATE OF CORRECTION

PATENT NO. : 5,292,223

DATED : March 8, 1994

INVENTOR(S) : Luciano Meschi

It is certified that error appears in the above-indentified patent and that said Letters Patent is hereby corrected as shown below:

On the title page, item [75], "Leghorn" should read --Livorno--.

Signed and Sealed this

Twelfth Day of July, 1994

Bruce Lehman

*Attest:*

BRUCE LEHMAN

*Attesting Officer*

*Commissioner of Patents and Trademarks*